US005311805A

United States Patent [19]

Muller

[11] Patent Number: 5,311,805

[45] Date of Patent: May 17, 1994

[54] VOICE SCRIBE

[76] Inventor: Edward A. Muller, 2142, Rte. 82, LaGrangeville, N.Y. 12540

[21] Appl. No.: 839,488

[22] Filed: Feb. 20, 1992

[51] Int. Cl.[5] ..... G10G 7/00

[52] U.S. Cl. ..... 84/460; 84/312 R

[58] Field of Search ..... 84/312 R, 454, 459, 84/460

[56] References Cited

U.S. PATENT DOCUMENTS

| | | | |
|---|---|---|---|
| 465,505 | 12/1891 | Weser | 84/460 |
| 731,535 | 6/1903 | Bell | 84/460 |
| 738,877 | 9/1903 | Behringer | 84/460 |
| 1,454,727 | 5/1923 | Crissey | 84/460 |
| 3,537,639 | 11/1970 | Ruger | 234/94 |

*Primary Examiner*—Michael L. Gellner
*Assistant Examiner*—P. Stanzione
*Attorney, Agent, or Firm*—Joseph L. Spiegel; Joseph B. Taphorn

[57] ABSTRACT

A power-driven voicing tool simultaneously inserts into and withdraws from the felt of a piano hammer, needles to raise a nap thereon. A row of four needles is driven by two circularly moved cam surfaces on the ends of an assembly rotatable by a variable speed electric motor through a flexible drive cable. One cam surface lies outside the other and drives the external needles of the row of needles; the other drives the internal needles. The slopes of the two cam surfaces are different and one-hundred-and eighty degrees out-of-phase with each other and effect different movements in adjacent needles, one needle moving outward while the other moves inward. A process of inserting a needle while withdrawing an adjacent needle in the felt of the piano hammer, is practiced.

10 Claims, 4 Drawing Sheets

VOICE SCRIBE

INTRODUCTION

1. Field of the Invention

This invention relates to voicing tools, and more particularly to a power-driven voicing tool providing a quickness and precision unequaled in the industry.

A Disclosure Document evidencing conception of the invention and signed by the inventor on Dec. 16, 1991, was received in the United States Patent and Trademark Office on Dec. 20, 1991 and given identification number 298,028.

2. Background of the Invention

In a typical acoustic piano, the sound produced is generated by padded mallets, called hammers, striking the strings. A typical hammer consists of a wooden frame with a strip of dense wool felt adhered to the frame surface and which contacts the strings. Each key on a piano is connected to an individual hammer through a linkage called "the action".

The purpose of voicing a piano is to regulated the tone quality of each string/hammer combination and/or to equalize them. Voicing is an operation in which the wool felt on the hammer is softened by piercing the surface with needles. The softening entails raising the nap or needle of the felt.

The most commonly used method is to repeatedly drive a voicing tool or pick into the felt. A voicing tool is similar to an awl; however it possesses a retainer which houses up to four needles. A technician using the tool must steady the hammer with one hand and repeatedly plunge the needles into the felt with the other. To adequately soften a felt can take as many as fifty (50) strike with the tool. Most pianos have eight-eight (88) hammers, so properly voicing the instrument becomes an extremely tedious and time consuming task.

By needling (voicing) the end of the hammer wool, the sound produced by a very hand hammer can be changed from a hard or loud sound to a soft one. Needling (voicing) is also done to even the quality of the sound produced by the different piano strings.

3. Prior Art

Voicing tools used today are awl-like, in that a number of needles fixedly mounted on the end of a tool are manually forced into the hammer wool or felt. U.S. Pat. Nos. 700,200 (Hoover) and 1,454,727 (Crissey) show manually operative mechanisms attempting to improve on the awl-like tools for moving an array of needles into and out of a piano hammer felt. U.S. Pat. Nos. 465,505 (Weser) and 1,432,976 (Donoho) show motor-driven slides carrying a plurality of fixed needles into and out of "felted" material of a garment or fabric to restore nap. U.S. Pat. No. 3,537,639 shows mechanisms for adjusting the amount of displacement that a movable element will engage in.

SUMMARY OF THE INVENTION

Accordingly, it is an object of this invention to provide a voicing tool that significantly reduces the time required to voice a piano.

A further object of the invention is to provide a voicing tool that enables more precise voicing of a piano.

A still further object of the invention is to simplify the process of voicing a typical acoustic piano.

Another object of the invention is to provide a more satisfactory power-driven voicing tool.

Still another object of the invention is to provide a voicing tool that is easy to use and one that is reliable in operation.

A more specific object of the invention a power-driven voicing tool that can be easily handled and manipulated by the user.

Yet another object of the invention is to provide a voicing tool that is simple of construction and easy of manufacture.

The objects of the invention are achieved in a power-driven tool in which some needles are being driven into the felt of the piano hammer while others are being withdrawn. This allows for the power penetration to the full depth of the piano-hammer felt without disruption or destruction thereof. A smooth operation with minimal vibration obtains.

A feature of the invention is that the tool may be tapered to allow the user an unimpaired view of the needles. The tapering is achieved by placing a driven element at one end of the tool and connecting it to a nose cone from whose tapered end the needles project at the other end of the tool, with a relatively slim intermediate or spacer portion housing the output drive mechanism.

BRIEF DESCRIPTION OF VAIOUS VIEWS OF THE DRAWINGS

The above and other objects, features and advantages of the invention will become apparent from a reading of the following description, when considered with the accompanying drawings wherein.

DETAILED DESCRIPTION OF A PREFERRED EMBODIMENT OF THE INVENTION

Figure 1:
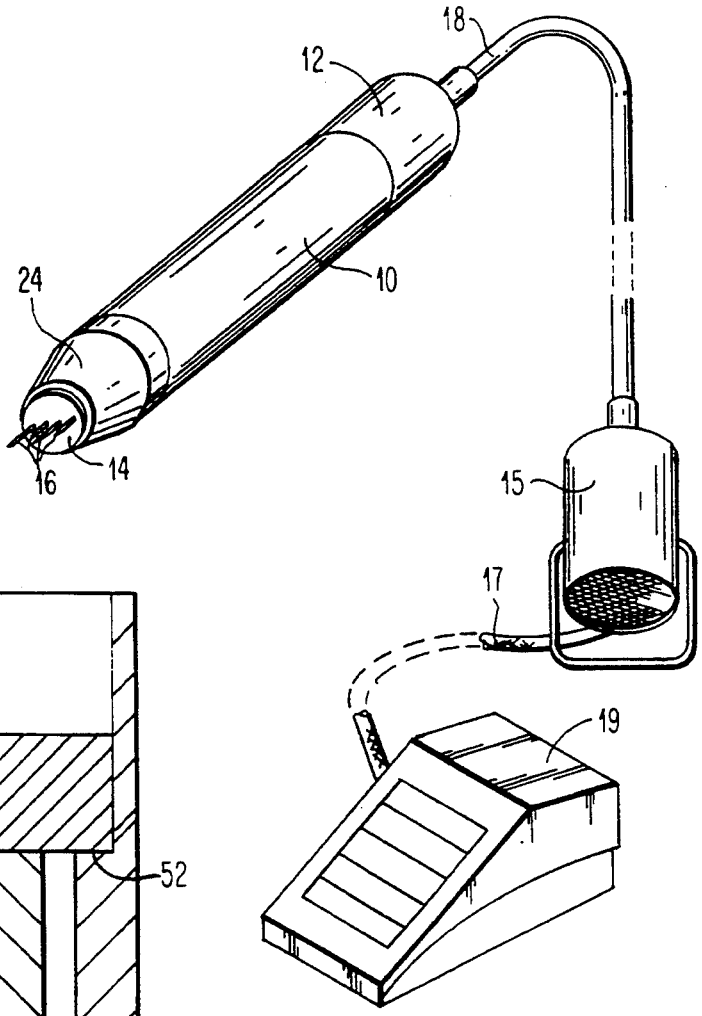
FIG. 1 is a schematic isometric view of a power-driven voicing tool constructed according to the invention.

Referring now more particularly to FIG. 1 of the drawings, a power-driven voicing tool is shown as including a main tubular body portion or spacer cylindrical housing 10 for grasping the tool. A housing 12 at one end of the spacer housing 10 mounts the output end of a commercially-available boden-cable drive 18 connected at its input end to a conventional variable-speed electric motor 15 connected via an electrical cable to a foot-operated speed control 19. The housing or cable 12 has its inner end fitted to the upper or right-hand end of the tubular body portion 10. A bushing guide 14 extends from a nose cone 24 on the lower or left-hand end of the tubular body portion 10 and mounts four needles or pins 16 for penetrating the felt of a hammer.

It should be understood that depression of the pedal of the foot-operated speed-control 19 completes a circuit to operate the electric motor; further depression allows increased electric motor speeds. Hence the operator can adjust the speed of the voicing tool to the requirements of the situation.

It should also be understood that a variable-speed electric motor could be mounted directly in the housing 12.

Figure 2:
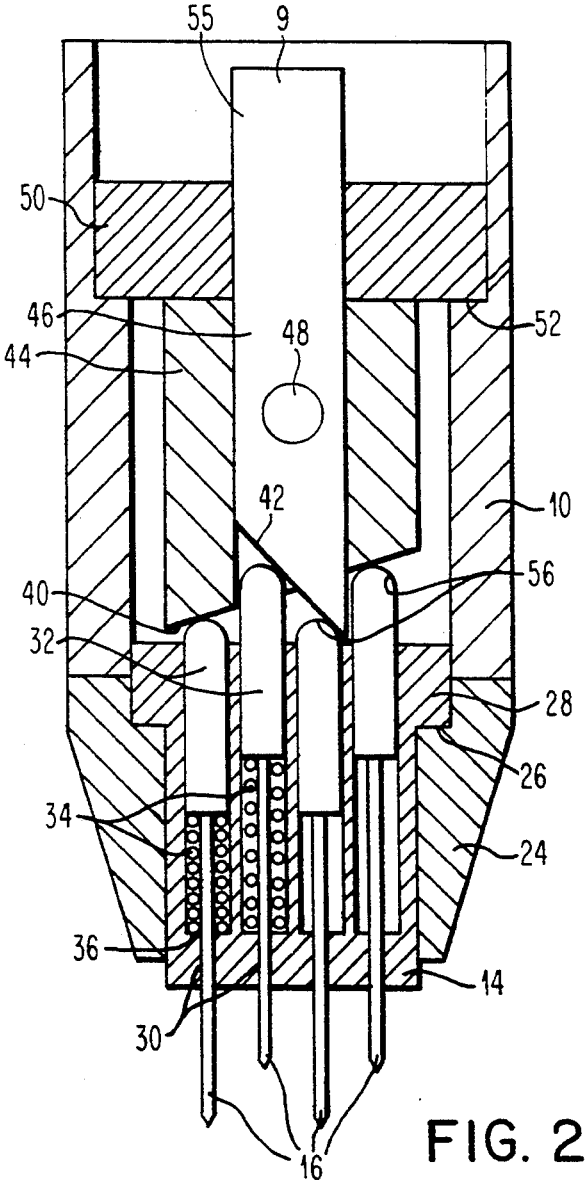
FIG. 2 is a schematic side view of a portion of the tool of FIG. 1, showing the mechanism for converting the rotary motion of a power-driven element into one-hundred and eigthy (180) degree out-of-phase reciprocating motions for various needles.
Figure 3A:
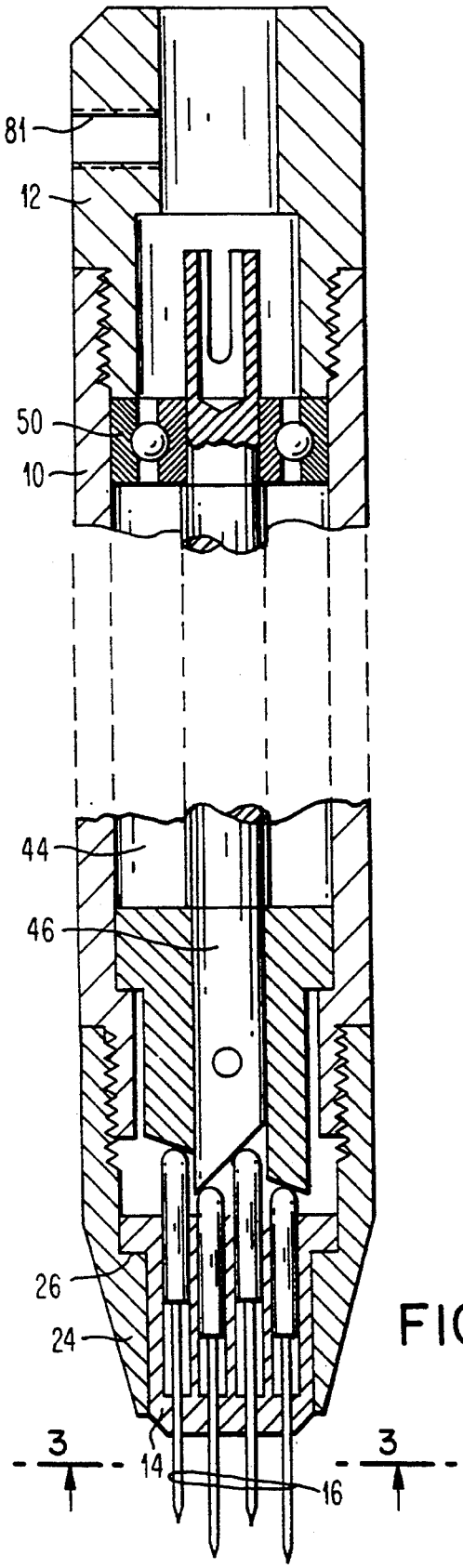
FIG. 3A is a sectional side view of the hand-held portion of a voicing tool according to a preferred embodiment of the invention.
Figure 3:
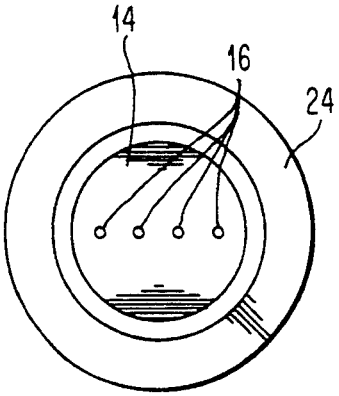
FIG. 3 is an end view of the left hand end or nose cone of the apparatus of FIG. 2.

Turning now to FIGS. 2 and 3, the needle mounting bushing guide 14 is shown as being seated in the left-hand end of the tubular housing 10. The left-hand end of the housing 10 mounts a nose cone 24 having a cylindrical interior which snugly but slidably receives and seats the cylindrical bushing guide 14. The inner end of the nose cone 24 has a shoulder 26 which seats the enlarged inner end 28 of the bushing guide 14 and limits its outward excursion.

The bushing guide 14 mounts the round needles 16 in individual round holes 30. The inner ends of the holes 30 are enlarged and snugly yet slidably mount and guide enlarged inner ends 32 of the pins 16. Compression springs 34 about the pins 16 react between a shoulder 36 formed in the bushing 14 at the offset of each hole 30 and its enlargement, and a shoulder 38 formed on each needle 16 and its enlarged inner end 32, to bias the pins inward.

The inner ends 32 of the outer and inner pins 16 are biased into riding engagement with outer and inner cam surfaces 40 and 42, repectively. These cam surfaces 40 and 42 are formed on respective ends of a tube 44 and a round shaft 46 fitted within the tube 44 and fixed thereto by a roll pin 48 to form a rotatable element. The slopes of the cam surfaces 40 and 42 are one-hundred and eighty degrees out of phase with each other, and differ in degree, the slope of the inner cam surface 42 being steeper than that on the outer one 44 for reasons that will eventually become apparent.

The shaft 46 extends through a radial bearing mounted in the housing 10 against a shoulder 52, and hence, along with the tube 44, is rotatably supported thereby. The end 55 of the shaft 46 has an internal opening 91 to facilitate a driven connection with the rotor of the drive cable 18 terminating in the housing 12. Operation of the electric motor 15 results in a rotary motion being imparted to the cable rotor, and therefor to the shaft 46 and tube 44 and hence to their end cam surfaces 42 and 40.

As noted earlier, the inner ends 32 of the inner and outer pins 16 are biased repectively against the inner and outer cam surfaces 42 and 40, and sliding contact with the cam surfaces is abetted by forming rounded surfaces 56 on the pin's inner ends 32. As the cam bearing members 44 and 46 are rotated, their surfaces opposite particular pins 16 will advance and others will receded, with the result that some pins 16 will be moving outward under the force of the advancing cam surfaces to penetrate a hammer felt, while others will be moving inward under the bias of the springs 34 to follow receding cam surfaces and withdraw from a hammer felt.

In applicant's preferred embodiment, four needles or pins 16 are employed. Two pins are moved outward to penetrate a felt, while two pins are being withdrawn, and the penetrating pins are always separated by a withdrawing pin. Thus as seen in FIG. 2, the upper end the second-from-the-bottom pins are at their most outward or penetrating positions, whereas the lower pin and the second-from-the-top are in their maximum retracted positions, the latter two having retracted from the felt while the first two were penetrating, to create somewhat balanced opposing forces minimizing vibration and tearing of the hammer felt. As the cam bearing members rotate, the cam surfaces advance and receded and effect needle movement accordingly. The steeper slope on the cam surface 42 reflects its reduced lateral extent thereof, compared to that of the cam surface 40.

Figure 4:
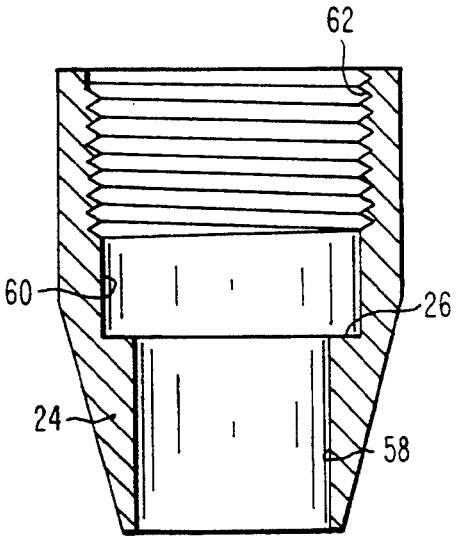
FIG. 4 is an enlarged sectional side view of the nose cone of FIG. 3A.

FIGS. 3A–11 show in detail parts of the voicing tool as embodied in a preferred embodiment depicted overall in FIG. 3A. Thus FIG. 4 shows in detail the design of the nose cone 24, which mounts the bushing guide 14. The shoulder 26, which limits the outward excursion of the bushing guide 14 in the central cylindrical opening 58 in the outer end of the nose cone, is defined by the offset between the opening 58 and an enlarged cylindrical opening 60 that extends backward from the shoulder 26 to receive the enlarged inner end 28 of the bushing guide 14. A further central cylindrical opening having female threads 62 extends backward from the opening 60 to snugly receive the threaded end of the left hand end of the spacer housing 10 of FIG. 3A (right-hand end in FIG. 5).

Figure 5:
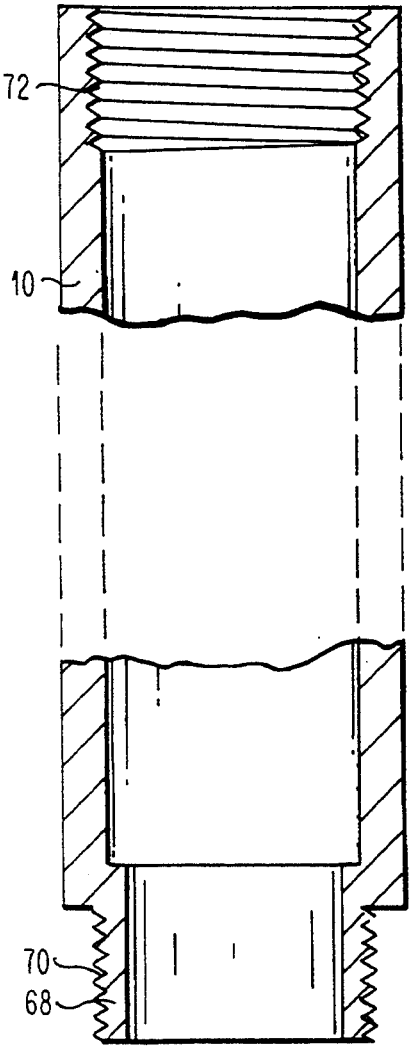
FIG. 5 is a sectional side view of the spacer housing of FIG. 3A, reversed end-wise from the showing in FIG. 3A.

FIG. 5 shows the design of the spacer or drive housing 10, reversed endwise from that of FIG. 3A. Thus the reduced end 68 for reception in the nose cone 24, appears on the right. The outer surface of the reduced end is formed with male threads 70 that are received in the female threads 62 carried by the nose cone to secure the parts when fitted together. The interior of the other end of the housing 10 bear interior female threads 72 to receive a portion of the cable mount 12.

Figure 6:
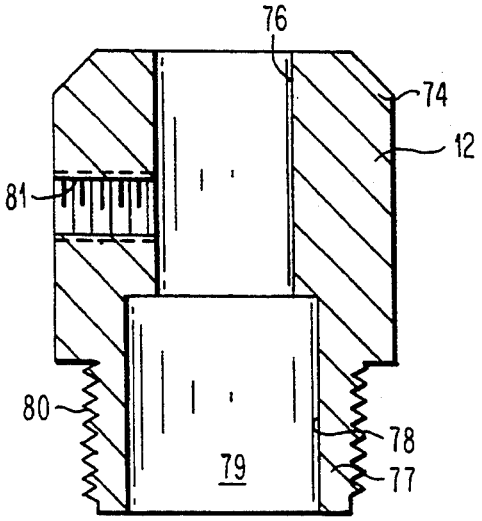
FIG. 6 is an enlarged sectional side view of the power-connection housing or end cap of the tool, reversed end-wise from the showing in FIG. 3A.

FIG. 6 shows the design of the cable mount 12, and too reversed endwise from that of FIG. 3A. The mount is shown as including a heavy left end portion 74 having a reduced diameter internal opening 76 for mounting the drive cable and a thinner right hand portion 77 having a larger diameter internal opening 78 yet smaller external diameter, the external diameter possessing male threads 80 to allow the housing 12 to be snugly seated within the female threads 72 of the spacer housing 10. The larger internal diameter opening 78 would receive the back end of the main cam shaft 46.

A threaded opening 81 accommodates a set screw (not shown) to hold the end of the sheath of the cable 18 firmly in the housing 12.

Figure 7:
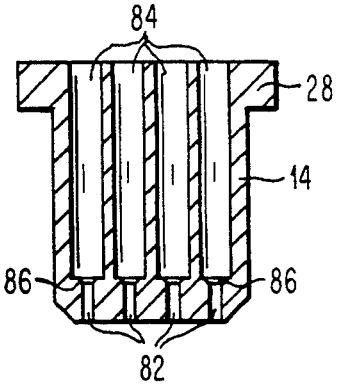
FIG. 7 is a longitudinal sectional view of the FIG. 3A bushing guide for the needles and that fits within the nose cone of FIG. 4.
Figure 7A:
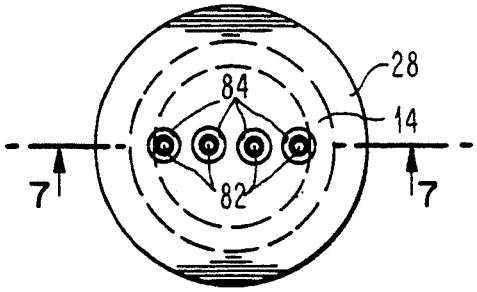
FIG. 7A is a view of the right-hand end of the bushing guide of FIG. 7.

FIGS. 7 and 7A show the detailed design of the bushing guide 14. Needle openings 82 are formed in middle of the left hand-end of the bushing guide (FIG. 7); four of them are shown as arranged in a row across the back of it, as portrayed in FIG. 7A. Enlarged diameter openings 84 back up the needle openings 82 and provide a shoulder 86 with each for limiting the outward excursions of the needles 16.

Figure 8:
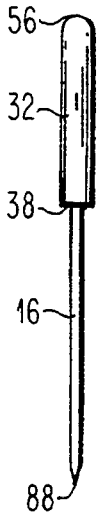
FIG. 8 is an enlarged side view of a needle of FIG. 3A and arranged vertically.

FIG. 8 shows a typical needle 16 with a sharp point 88 and having for the main part a diameter so as to be snugly yet slidably received in the openings 82 of the bushing guide 14. The rear (top in FIG. 8) enlarged end 32 of the needle is of enlarged diameter so as to be slidably received in openings 84 of the bushing guide and of a length so as to project beyond the end of the guide. The shoulder 38 formed at the meeting of the smaller and larger diameters, serves as an abutment for a spring 34. The surface 56 of the free end of the enlarged diameter needle end 38 is rounded to provide free sliding contact with the cam bearing members 44 and 46.

Figure 9:
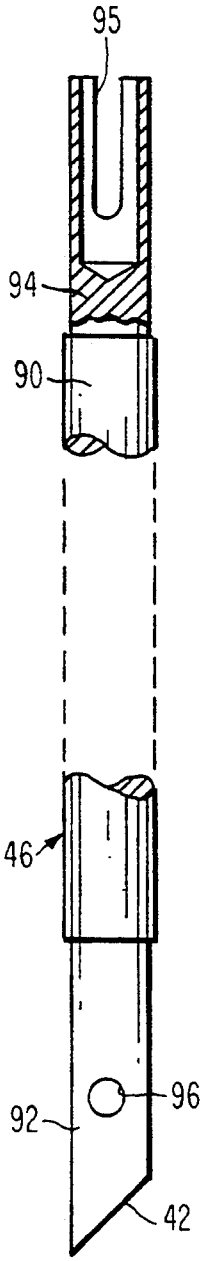
FIG. 9 is a side view of the main cam shaft of the drive mechanism of FIG. 3A.

FIG. 9 shows the design of the main cam shaft 46. The main cam shaft 46 has a thicker central portion 90 and reduced end portions 92 and 94. The left hand end portion 92 terminates in a sloping cam surface 42. A diametrical opening 96 in the left hand end portion 92 serves to mount the roll pin 48 for fixedly connecting the main cam shaft 46 to the cam shaft member 44.

The other or right hand end portion 94 of the main cam shaft 46 has an opening 95 of similar cross-section to that of the driven element or rotor of the cable 18 so as to enable it to be rotated thereby.

Figure 10:
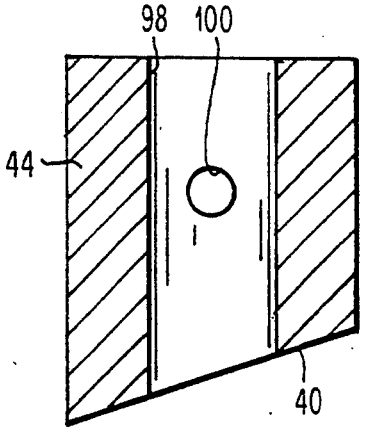
FIG. 10 is an enlarged side view of the outer sleeve cam of the drive mechanism of FIG. 3A, rotated clockwise ninety (90) degrees.
Figure 11:
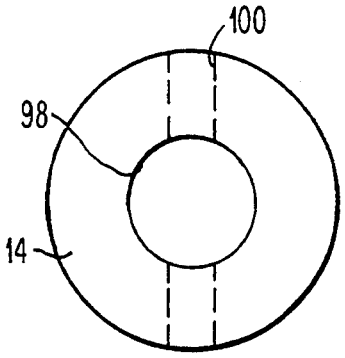
FIG. 11 is view taken along the section line 10—10 of FIG. 9, and rotated ninety (90) degrees.

FIGS. 10 and 11 show the design of the tubular cam or outer sleeve member 44. The sleeve has on its upper end surface (FIG. 10) the cam surface 40. Its central opening 98 is of a diameter sufficient to receive the main cam shaft 46. A diametrical opening 100 intersects the opening 98 and serves to hold the free end of the roll pin 48 for drivingly connecting the cam-outer sleeve member 44 to the main cam shaft 46 and for locating it axially.

It will appreciated that applicant has provided a power-driven voicing tool which functions in a new way to reliably and quickly soften the felt on piano hammers. The tool is simple of construction, utilizing just a few parts. It is easy of manufacture as the parts can be readily machined or molded.

It will also be appreciated that while applicant has disclosed a preferred embodiment of the invention, that other applications embodying principles of the invention will be evident to those skilled in the art. Accordingly, it is desired to be limited on by the scope or spirit of the appended claims.

What is claimed is:

1. A voicing tool comprising at least four needles arranged in sets in a row, the movement of adjacent needles being one hundred and eighty degrees out of phase, one of said needles being advanced while another of said needles is being retracted from the wool end of a piano hammer.

2. A voicing tool according to claim 1, wherein sets of needles are driven by first and second cams.

3. A voicing tool according to claim 2, wherein said first cam drives the two inner needles in the row.

4. A voicing tool according to claim 2, wherein said second cam drives the two outer needles in the row.

5. A voicing tool according to claim 3, wherein said second cam drives the two outer needles in the row.

6. A voicing tool according to claim 5, wherein said two cams are surfaces formed on the end of a rotatable element and engaged by the inner ends of the needles.

7. A power-driven voicing tool comprising an elongated housing, a power-driven element on said housing, needles projecting from one end of said housing for penetrating wool on piano hammers, and means connecting said power-driven element with said needles to advance one of said needles while an adjacent one of said needles is being retracted, said means including an element rotated about the axis of said housing and being driven by said power-driven element.

8. A power-driven voicing tool according to claim 7, wherein a cam face is formed on the end of the rotatable element and engaged by a needle.

9. A power-driven voicing tool according to claim 8, wherein another cam face is formed on the end of the rotatable element and engaged by another needle.

10. A power-driven voicing tool according to claim 9, wherein four needles are arranged in a row, and one cam face is outside of the other and of a different slope and drives the outer needles of the four while the other drives the inner needles of the four, the movement of adjacent needles being one-hundred-and-eighty degrees out-of-phase, and the tool is a variable-speed one.

* * * * *